United States Patent [19]

Reschovsky

[11] 4,354,190

[45] Oct. 12, 1982

[54] ROTOR MEASUREMENT SYSTEM USING REFLECTED LOAD TRANSMISSION

[75] Inventor: John M. Reschovsky, Schenectady, N.Y.

[73] Assignee: General Electric Company, Schenectady, N.Y.

[21] Appl. No.: 137,422

[22] Filed: Apr. 4, 1980

[51] Int. Cl.[3] ..... G08C 19/16

[52] U.S. Cl. ..... 340/870.18; 340/870.32; 340/870.39; 340/870.42

[58] Field of Search ..... 340/870.01, 870.1, 870.16, 340/870.17, 870.18, 870.26, 870.32, 870.38, 870.39, 870.42; 323/75 N

[56] References Cited

U.S. PATENT DOCUMENTS

| | | | |
|---|---|---|---|
| 3,657,717 | 4/1972 | Glantschnig et al. | 340/870.39 |
| 3,742,473 | 6/1973 | Hadden | 340/870.39 |
| 3,758,845 | 9/1973 | MacKelvie et al. | 340/870.39 |
| 4,150,358 | 4/1979 | Avander | 340/870.31 |
| 4,198,621 | 4/1980 | Roper | 340/870.39 |
| 4,225,851 | 9/1980 | Reschovsky et al. | 340/870.18 |
| 4,232,922 | 11/1980 | Teass | 73/136 A |
| 4,242,665 | 12/1980 | Mate | 340/870.39 |
| 4,242,666 | 12/1980 | Reschovsky et al. | 340/870.28 |

FOREIGN PATENT DOCUMENTS

| | | | |
|---|---|---|---|
| 1527361 | 10/1978 | United Kingdom | 340/870.39 |

OTHER PUBLICATIONS

"Telemetry Standards", Aydin Vector Division, Nov. 1975.

*Primary Examiner*—James J. Groody

*Attorney, Agent, or Firm*—Ormand R. Austin; John F. Ahern

[57] ABSTRACT

An apparatus is provided for obtaining data from sensor measurements made on a body moving rotationally with respect to a stationary observer. Radio frequency energy is reactively coupled between an energy source fixed with respect to the observer and load varying means located on the moving body. The load variance is dependent upon measurement data provided by sensors located on the moving body. The variation in load is reflected back through the reactive coupler to a detector which is fixed with respect to the observer. The detector operates to provide signals indicative of the measurement data provided by the sensors. The apparatus of the present invention may be easily retrofitted to rotational devices such as turbines, motors and generators to provide relevant, continuous, on-line measurements of important parameters associated with such rotating systems. These parameters include such measurements as temperature, pressure, strain and torque. Because of the reflected load nature of the formation transmission, only a single coupling is provided and this coupling serves to carry both power and information signals.

7 Claims, 3 Drawing Figures

ROTOR MEASUREMENT SYSTEM USING REFLECTED LOAD TRANSMISSION

BACKGROUND OF THE INVENTION

This invention relates to an apparatus for acquiring information from sensor measurements made on a body moving with respect to a stationary observer. More particularly, this invention relates to transmission means for acquiring temperature, pressure, torque, strain and the like sensor measurement data from a rotating object or device.

Since various rotating machines such as turbines, motors and generators may often be operated under critically optimal or stressful conditions, the need for accurately determining internal device conditions has increased. This greater need for sensor data generally occurs because of two reasons. First, it is becoming increasingly desirable to operate various machines at optimal or near optimal conditions and doing so requires greater information on various parameters associated with the rotating parts themselves. In these situations indirect or secondary data measurements from peripheral sensors may not be sufficiently accurate, reliable or reflective of actual internal conditions. Second, as various rotating devices are operated at increasingly higher load ratings, it becomes increasingly desirable to accurately determine system conditions which should not be exceeded. Accurately sensing these conditions is important to ensure that protective control systems operate in a sufficiently adequate manner, such as by reducing or cutting off the power to the system prior to device damage. Furthermore, the emergence of digital and analog control systems which are implemented on large-scale integrated circuit chips has greatly facilitated the ability to implement control systems having a large number of input signal parameters.

In the past, sensor information transmission between rotating and fixed parts has been difficult and costly for several reasons. For example, a method of providing electrical power for the rotating sensors and transmission system must be provided. Battery power is inconvenient for such systems because of the relatively short lives of chemical batteries. Accordingly, other information and transmission systems have employed direct slip ring connections between the stationary and rotating parts. However, this is an inconvenient power transmission method which often obscures the signal with noise. Furthermore, slip ring connections are difficult to maintain, require regular attention and generally involve some degree of mechanical interference. Because of the problems associated with the brush connections for providing power to various rotating electronic data generating systems, others have employed reactive coupling to transfer the desired power. For example, transmission of desired power may be affected by radio frequency electromagnetic coupling between a fixed coil and a coil rotating with the motor or generator shaft. However, because large motors and generators in particular often produce relatively high levels of radiated electromagnetic noise, conventional data acquisition systems may experience severe noise problems. Additionally, it is not only necessary to provide power to a rotating data acquisition system, it is also necessary, in conventional systems, to provide a second independent channel for the transmission of data signals from the rotating body to a relatively fixed observer. This is accomplished in conventional systems by the transmission of frequency or amplitude modulated carrier signals. Moreover, these systems are also subject to noise problems and are unnecessarily complex and costly.

SUMMARY OF THE INVENTION

In accordance with a preferred embodiment of the present invention, an apparatus for obtaining data from sensor measurements made on a rotating body moving with respect to a stationary observer comprises reactive means for coupling a radio frequency energy source to load varying means on the moving body. The load is varied in accordance with measurements provided by data sensors on the moving body and the variation in load is reflected back through the reactive coupling means to fixed detector means which is responsive to load variations.

More particularly, in accordance with one preferred embodiment of the present invention, voltage dependent sensors control a voltage controlled oscillator which switches the power supply for the oscillator between "on" and "off" states at frequencies dependent upon the measured parameters. The power supply is inductively coupled to a stationary coil through which it receives radio frequency energy which it employs, after rectification and filtering, if desired, to power the oscillator and sensors. Thus, variations in load are reflected back through the inductive coupling coils to a detector which is responsive to these variations.

Accordingly, it is an object of the present invention to provide data transmission means between a fixed observer and a body moving relative thereto. It is a further object of the present invention to provide such a data transmission apparatus which is easily retrofitted to existing machinery, is inexpensive, simple, and exhibits high noise immunity, particularly in environments employing relatively high power inductive machinery.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF THE INVENTION

Figure 1:
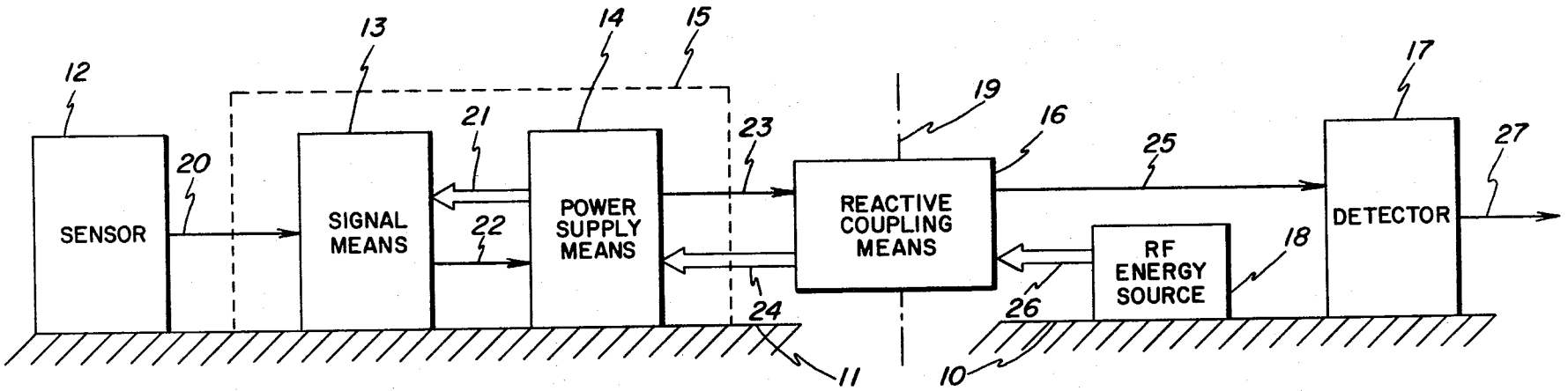
FIG. 1 is a functional block diagram illustrating the relationship between the elements of the present invention.

FIG. 1 illustrates a reflected load data transmission system for coupling information signals between fixed reference frame 10 and moving reference frame 11. Line 19 delineates the fixed parts from the moving parts of the system. The apparatus of the present invention functions as follows. Radio frequency (RF) energy source 18 supplies RF energy 26 to the reactive coupling means 16 which may comprise either a capacitive or an inductive coupling. Part of the reactive coupling means is fixed and the other part moves with reference frame 11. For present purposes, the motion of reference frame 11 can be thought of as being rotational. The reactive coupling means 16 provides radio frequency energy signals 24 to the load varying means 15. Load varying means 15 also receives signals 20 from sensor or sensors 12 and operates to vary the load in response to electrical output signals 20 from the sensor apparatus 12. The variation in load is reflected back through the reactive coupling means as a time-varying load signal 23. It is to be particularly noted that in FIG. 1 the wider arrows (21, 24 and 26) represent power signals and the other arrows represent information signals. However, it is to be particularly noted with respect to lines 23 and 24, that they are shown here separately merely for conveying a functional understanding but that in fact, in the preferred embodiment of the present invention, separate transmission channels for signal and power are unnecessary. The load variation signals 25 as seen from the stationary reference frame 10 are then supplied to detector 17 which produces electrical signals 27 which are indicative of the sensor measurements.

In particular load-varying means 15 typically comprises a signal generating means operating to provide electrical signals 22 which depend on the data produced by sensor apparatus 12. The signal means receives power signals 21 from power supply means 14 and further interacts with the power supply means by providing it with electrical signals 22 which operate to switch the power supply means on and off in accordance with information derived from the sensor signals 20. In this way then the load seen by the power supply means 14 varies in dependence upon sensor signals 20. It is this load variation which is reflected across the reactive coupling means 16 which also serves as a source of electrical energy to operate the power supply means 14 and the signal means 13 and if necessary the sensor apparatus 12. If necessary, the power supply means may also include a capacitive storage means which operates to provide electrical energy to the signal means 13 during those times in which electrical signals 22 have operated to remove the signal means as a load upon the power supply means.

Because the power supply load is itself switched, load variation signals are coupled back across through the reactive coupling means to the stationary reference frame 10. Accordingly, only one reactive coupling means need be provided and the channel which supplies power signals to the rotating load varying means also acts to transmit sensor information to the detector. While load variation may assume a variety of dependencies, it is most convenient to have the load vary in a binary, that is on and off fashion. This resulting mode of operation produces digital transmission of information exhibiting a high degree of noise immunity.

Figure 2:
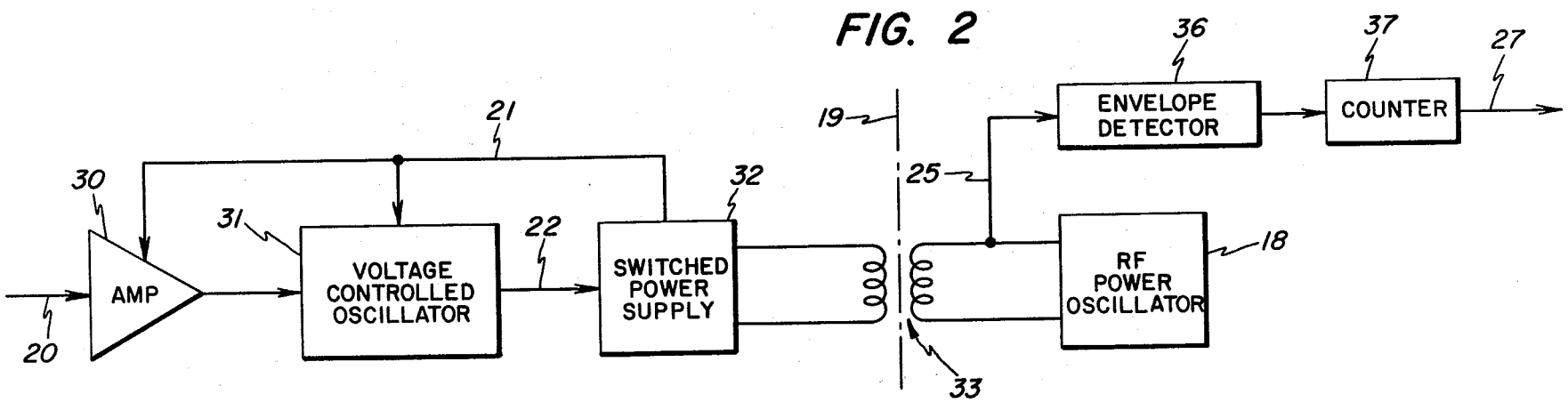
FIG. 2 is a functional schematic diagram illustrating one embodiment of the present invention.

FIG. 2 illustrates one embodiment of the present invention in which the reactive coupling means comprises a pair of coils 33, one of which is fixed with respect to the stationary reference frame of the observer and the other of which is fixed with respect to the rotating reference frame. Radio frequency energy is transferred across coils 33 from RF power oscillator 18. This RF energy is received by switched power supply 32 which preferably comprises a full-wave rectifying bridge circuit, a filter capacitor connected across the output of the bridge circuit and a controlled electronic switch connected in series between the capacitor and the bridge so as to provide controlled dc power signals 21 to voltage controlled oscillator 31 and amplifier 30. Amplifier 30 receives information signals from sensors or transducers on the rotating reference frame and amplifies them so as to drive the voltage-controlled oscillator 31. This oscillator produces electrical signals 22 which operate the electronic switch to intermittently disconnect the dc current 21 demanded from the rectifier. Thus, there is a time-varying load dependency which is reflected through coils 33 back to the fixed reference frame. These "reflected" signals 25 may be conveniently detected by means of an envelope detector 36. The load variations are then counted by counter 37 over a specified period of time. This count is a signal 27 which is dependent upon the sensor voltage applied to the voltage controlled oscillator 31. It is to be particularly noted, that in this embodiment of the present invention, the frequency of oscillator 31 is preferably chosen to be an order of magnitude or more below the frequency of oscillation of RF power oscillator 18.

The electrical circuits which are attached to fixed reference frame 10 are conveniently implemented using a single transistor circuit operating as an oscillator whose output drives a single transistor Class C amplifier. Class C amplifier circuits are particularly suited for this purpose since their supply current varies directly with the load to which their output is connected. The resulting swings in supply current to the Class C amplifier are then readily detected and counted. In this manner the inherent characteristics of the Class C amplifier permit it to also function as an envelope detector.

Figure 3:
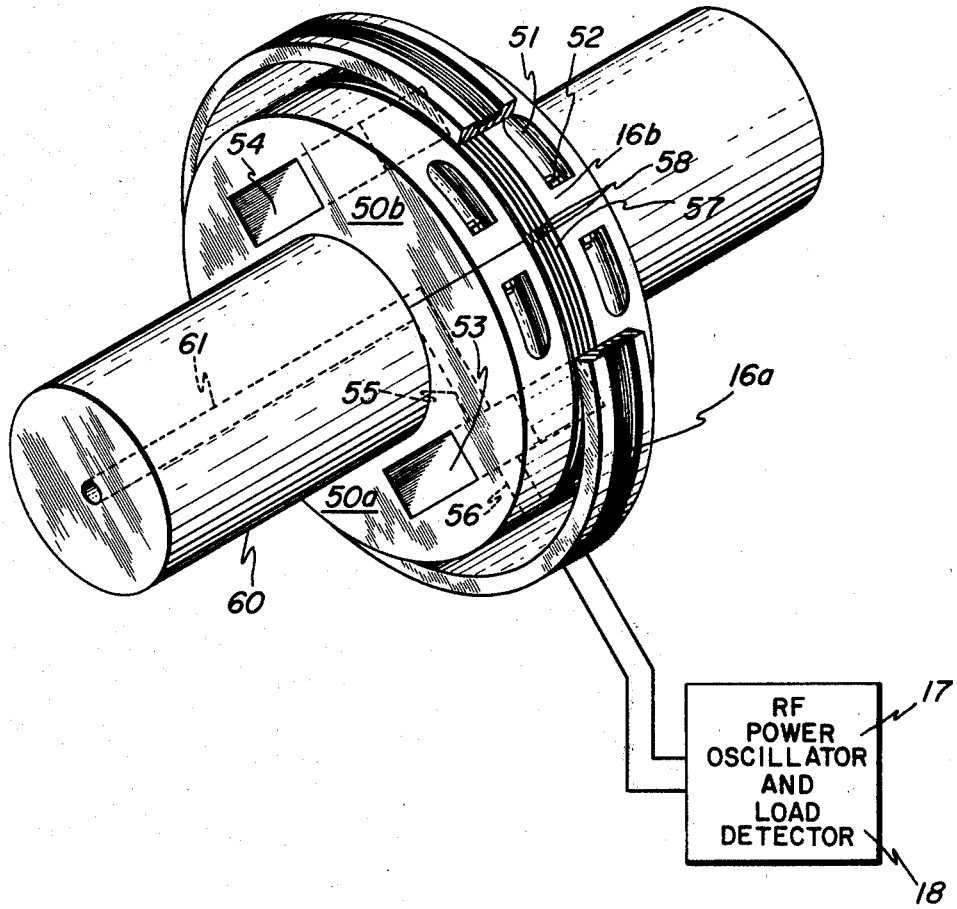
FIG. 3 is a perspective view illustrating a typical environment in which the present invention may be employed.

FIG. 3 illustrates a typical environment in which the present invention may be employed. Moreover, FIG. 3 illustrates further advantages associated with the present invention. In this figure RF power oscillator 17 drives fixed inductive coil 16*a* which frequently comprises only a single turn of wire. However, in general, the number of turns employed depends on the coil diameter, the frequency used and impedance matching requirements. Coil 16*a* is electromagnetically coupled to coil 16*b* which rotates with motor shaft 60. Coil 16*b* as shown comprises approximately four turns of wire which are disposed in channel 57 formed in the periphery of an annular disc formed from disc halves 50*a* and 50*b*. Portions 50*a* and 50*b* are each semiannular disc halves which are joined by nuts and bolts 52 as shown. However, any convenient mechanical means of attachment of the two semiannular portions may be employed. The method of attachment shown though, conveniently disposes nuts and bolts 52 in recesses 51. For purposes of containing the circuitry of the present invention, recess 53 is provided in semiannular portion 50*a*. Also, conveniently provided is passage 56 through portion 50*a* for the passage of electrically conductive leads from the coil 16*b* to the load-varying means 15 of the present invention. Likewise, passage 55 is provided for electrically conductive leads connecting the sensors (not shown) with the load-varying means 15 of the present invention. The motor shaft 60 may also be conveniently provided with passage 61 extending in both axial and radial directions so as to align with passage 55. Alternatively, the conductor leads to the sensors may be affixed to the circumferential portions of the shaft 60 by means of an adhesive or other attachment means. Provided in portion 50*b* is a similar recess 54 which may be employed to hold counterbalance masses to balance the mass of the circuits provided in recess 53, particularly if high-speed shaft rotation is expected.

The particularly beneficial advantage of the present invention is its ability to be employed in retrofit applications. That is to say, the present invention is easily added to devices such as motors whose operating parameters need to be accurately determined. Addition of the present invention to an existing installation is readily accomplished by affixing the desired sensors and extending their leads in a suitable manner to rotating disc portions 50*a* and 50*b* containing the circuits of the present invention. Variations in load, as determined by the sensors, are reflected through coils 16*b* and 16*a* to load detector 18. The semiannular portion 50*a* and 50*b* provide a convenient means for attaching the present invention to the device to be monitored. Because these semiannular portions are designed to be mounted, and removed if later desired, coil 16*b* is provided with pin connectors 58 at the joints where the portions are fastened. Coil 16*a* may be supported by any convenient mechanical means, after which the oscillator 17 and detector 18 are connected and installation is complete. Thus, the present invention may not only be employed on newer machinery but is also employable on motors and generators which have been in the field for a number of years with no interference to normal operation. Furthermore, no mechanical connection between fixed and rotating parts is required.

In protective systems applications, the sensor data may be employed in a feedback arrangement to shut down the rotating device if specified limits are exceeded. For example, if the temperature on a motor rotor winding exceeds a preset value, the signals generated by the present invention may be employed to turn the motor off to prevent component damage.

While the present invention has been described in terms of rotary motion, the invention is also applicable to other relative motion between the respective frames of reference. However, compensation may be required for those situations in which the relative motion produces variable degrees of electromagnetic coupling between the stationary and moving portions. Alternatively, couplings, such as long coils, may be employed in certain situations to preserve the degree of electromagnetic coupling desired.

Furthermore, while FIG. 2 illustrates the particular case in which the power supply 32 is switched on and off according to the frequency content of electrical signals 22, other modes of switching are possible. In particular, the sensor output voltages may be converted to digital signals which are employed to turn the power supply 32 on and off. However, if this is done provision should be provided for the case in which a long string of zeros in the digital data output switches the power supply to an off state for an excessive time beyond which capacitive or other means are insufficient to power the sensors and digital converter circuits. However, many coding schemes are extant for the purpose of avoiding this problem. In particular, the digital data may be interspersed with binary "ones" which would not turn off the power supply. Other binary coding schemes which are not capable of producing long strings of zeros or ones include bi-phase coding which employs mid-bit level changes and delay modulation coding. Additionally, half-level codes in which the load is only reduced may be employed to ensure adequate power to the rotating circuit components.

From the above, it may be appreciated that the present invention provides an apparatus for the transmission of sensor measurement data from a body moving relative to a fixed observer. Furthermore, this data transmission system employs only a single channel, is highly immune to noise, may be constructed at low cost and can be easily retrofitted to existing machinery with minimum effort. Moreover, the single channel may be shared to provide information from a plurality of sensors.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. Apparatus for obtaining physical measurement data from a body moving with respect to a stationary observer, comprising:

at least one sensor means disposed on said moving body for providing an output signal indicative of at least one such physical measurement;

an electrical energy source fixed with respect to said observer for supplying a radio frequency power signal;

means reactively coupling said radio frequency signal to said moving body for supplying operating power to an electrical load thereon;

means disposed on said moving body and responsive to said sensor output signal to effect corresponding changes in said electrical load causing amplitude variations in said radio frequency power signal;

detector means fixed with respect to said observer and responsive to said radio frequency power signal for detecting said amplitude variations due to said load changes to provide an output signal characterizing said physical measurement, said load changes being reflected through said reactive coupling means.

2. The apparatus of claim 1 wherein said reactive coupling means comprises an inductive coupler having a first inductive portion fixed with respect to said observer and a second inductive portion affixed to said moving body.

3. The apparatus of claim 1 or 2 wherein said means responsive to said sensor output signal includes:

a voltage controlled oscillator producing a signal whose frequency is proportional to said sensor signal and a power supply connected to said electrical load and responsive to be switched between an on condition and an off condition at a rate corresponding to the frequency of said oscillator signal.

4. The apparatus of claim 3 wherein said detector means comprises:

an envelope detector providing a signal whose frequency is indicative of the switching rate of said power supply; and means providing a count of the frequency of said envelope detector signal, said count being indicative of said physical measurement.

5. The apparatus of claim 4 wherein said power supply further includes storage means providing power to said electrical load at such time as said power supply is in said off condition.

6. The apparatus of claim 5 wherein said electrical load includes said voltage controlled oscillator and said sensor means.

7. The apparatus of claim 6 further including an amplifier for amplifying said sensor output signal.

* * * * *